United States Patent [19]

Lavan, Jr.

[11] Patent Number: 5,069,109

[45] Date of Patent: Dec. 3, 1991

[54] TORPEDO COUNTERMEASURES

[75] Inventor: Charles K. Lavan, Jr., Medina, Ohio

[73] Assignee: Loral Corporation, New York, N.Y.

[21] Appl. No.: 610,669

[22] Filed: Nov. 8, 1990

[51] Int. Cl.[5] ..... B63G 9/00

[52] U.S. Cl. ..... 89/1.11; 114/240 C; 114/240 E

[58] Field of Search ..... 114/240 C, 240 E; 244/145; 89/1.11

[56] References Cited

U.S. PATENT DOCUMENTS

| | | | |
|---|---|---|---|
| 1,337,920 | 4/1920 | Kohler | 114/240 C |
| 3,173,636 | 3/1965 | Sepp | 244/145 |
| 3,240,451 | 3/1966 | Sepp | 244/145 |
| 3,766,880 | 10/1973 | Ramsey et al. | 114/241 |
| 3,840,202 | 10/1974 | Lemoigne | 244/145 |
| 4,231,311 | 11/1980 | Longerich | 114/244 |
| 4,768,417 | 9/1988 | Wright | 89/1.11 |
| 4,974,536 | 12/1990 | Archibald | 114/244 |

*Primary Examiner*—David H. Brown
*Attorney, Agent, or Firm*—L. A. Germain

[57] ABSTRACT

A device which is deployable in the ocean environment to defeat an active torpedo comprises a mesh net structure constructed of a plurality of flat ribbons oriented in a particular geometric orientation with uniform spacings between adjacent ribbons, the ribbons being comprised of synthetic materials and more particularly of SPECTRA yarns in combination with yarns taken from the group comprising nylon, polyester, aramid, and KEVLAR. The net structure has stitched interconnections of the ribbons and a diameter of at least ten feet and exhibits a packing density of about 45 lbs/ft$^3$ and a substantial neutral buoyancy in salt water.

14 Claims, 2 Drawing Sheets

TORPEDO COUNTERMEASURES

FIELD OF THE INVENTION

This invention generally pertains to torpedo countermeasures, that is, to anti-torpedo devices.

More particularly, the present invention pertains to an anti-torpedo device which may be deployed into the water environment to intercept an active torpedo and to interact with the torpedo in such a manner as to defeat it so that it cannot complete the intended mission.

Specifically, the present invention provides a passive anti-torpedo net structure which exhibits a high packing density for storage and deployment from an aircraft, a surface ship, and/or a submarine while also exhibiting structural strength and integrity to defeat an active torpedo in the water environment.

BACKGROUND OF THE INVENTION

Net structures which are intended to stop a torpedo have been used in coastal waters with a high degree of effectiveness as harbor and/or dam protection devices. Generally, these prior art nets have been fabricated from high strength metal cables and have been deployed as static structures in the water environment with anchorages to the ocean floor.

Various of these prior art devices are described and illustrated in the patent art as exemplified by U.S. Pat. No. 2,383,095 (D. A. Wallace); U.S. Pat. No. 2,170,481 (J. J. Morrison et al); and U.S. Pat. No. 2,388,459 (C. S. Allen, Jr.). These known net structures are costly to manufacture and, because of the method of construction and their significant weight, do not lend well to a high packing density for storage onboard light aircraft and/or in the limited spaces of a submarine.

Another known net structure is described and illustrated in U.S. Pat. No. 4,768,417 (J. E. Wright). This net is in the configuration of an active detonator weapon and it is comprised of lengths of nylon rope interwoven with detonator cord. The purpose of the net is to disable a target by way of the explosive detonator cord which is ignited by control packages carried on the net structure. The control packages include initiators for igniting the explosive detonator cord.

With the introduction of smart weapons, ie., acoustic homing torpedos and the like, a need exists for an anti-torpedo device which cannot be detected by these type smart weapons. The anti-torpedo device, therefore, must be passive and comprised of materials which are not ordinarily detectable by conventional methods. The anti-torpedo device must also be economical to manufacture in large quantities and lightweight enough to be carried onboard light aircraft. Furthermore, the anti-torpedo device must exhibit a high packing density for storage onboard aircraft as well as onboard a submarine where space is at a premium.

Therefore, it is in accordance with one aspect of the present invention an object to provide a lightweight, highly packageable, and economically produced passive anti-torpedo device.

In accordance with another aspect of the invention it is an object to provide a passive anti-torpedo net structure comprised of parachute type ribbon materials which exhibit a high structural integrity and the total net structure exhibits a substantially neutral buoyancy when it is deployed into a salt water environment.

In accordance with still another aspect of the invention it is an object to provide an anti-torpedo net comprised of ribbon materials, the ribbon materials being taken from a synthetic group comprising nylon, polyester, aramid, KEVLAR (KEVLAR is a registered trademark of the E. I. Du Pont de Nemours Company of Wilmington, Delaware) and SPECTRA (SPECTRA is a registered trademark of the Allied Chemical Corporation of Norristown, N.J.).

SUMMARY OF THE INVENTION

The foregoing aspects and other aspects and advantages of the present invention are provided in a device deployable into a salt water environment to defeat an active torpedo, the device comprising in combination: a plurality of flat ribbon materials in a geometric orientation at uniform spacings with stitched interconnections to form an integral net structure, the ribbon materials being taken from a group of synthetic materials comprising nylon, polyester, aramid, KEVLAR and SPECTRA and the particular combination of materials is such that the total net structure exhibits a substantial neutral buoyancy in a salt water environment.

BRIEF DESCRIPTION OF THE DRAWINGS

The present invention will be described with reference to the accompanying drawings in the several figures in which like reference numerals are used to indicate like elements and in which.

DETAILED DESCRIPTION OF THE INVENTION

Figure 1:
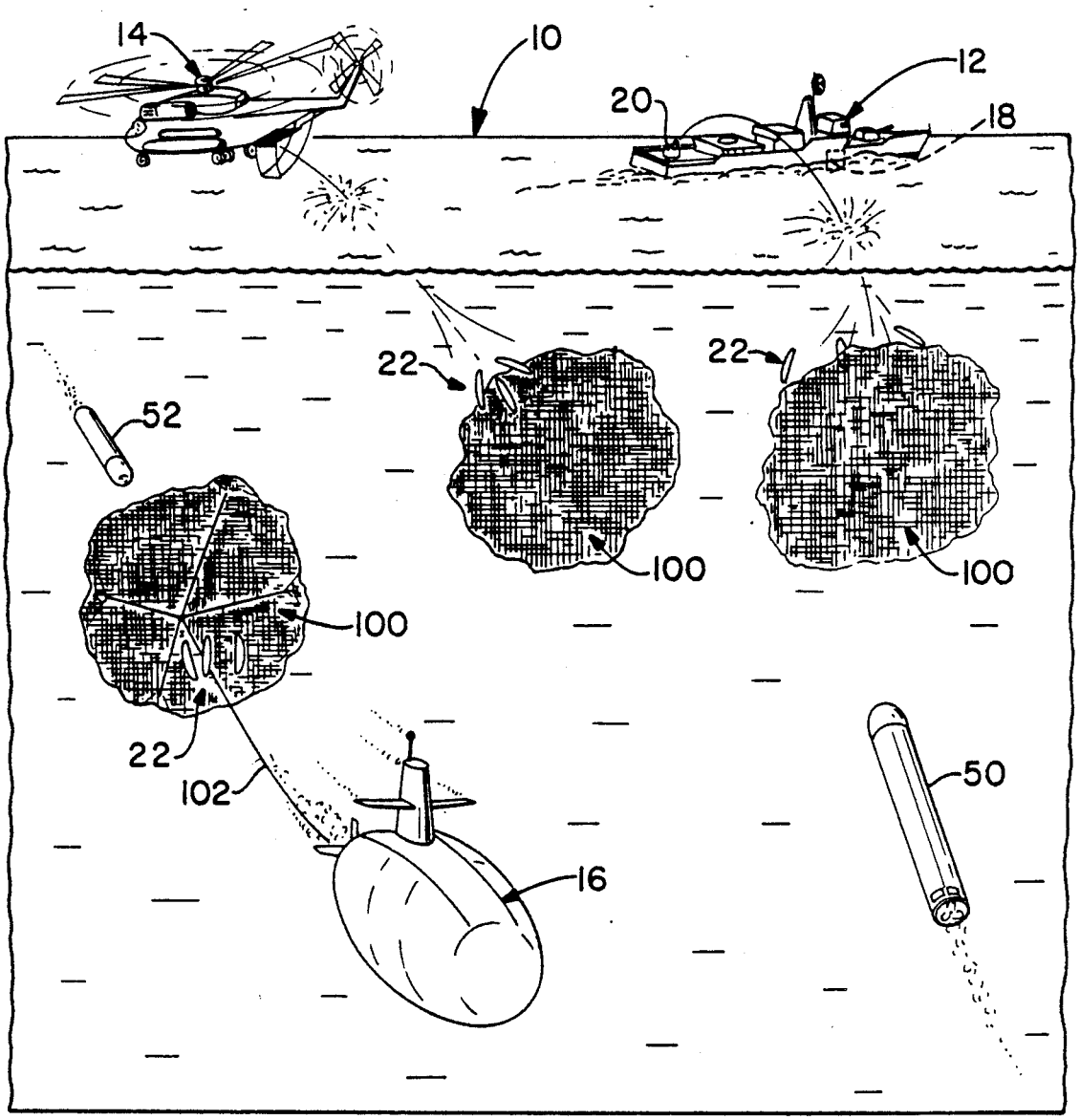
FIG. 1 is a pictorial illustration showing the invention as it may be used in the ocean environment and illustrating various modes of deployment which may be used to defeat an acoustic homing torpedo.

Referring to the drawings, FIG. 1 pictorially illustrates an ocean environment generally indicated by reference numeral 10 in which various military scenarios are depicted and these may include a surface ship 12, an aircraft 14, and a submarine 16.

In accordance with a first scenario as it pertains to the present invention, a torpedo 50 is illustrated as it may have been launched by an enemy submarine (not shown) to pose a threat to the surface ship 12. Of course, the ship 12 will carry some type of sonar detection equipment 18 onboard and its personnel will be appraised of the torpedo threat 50. While the ship 12 may carry various type of active self-protect devices which may be used against a torpedo threat, the particular ship 12 illustrated in the drawing also carries anti-torpedo nets 100 in accordance with this invention.

An anti-torpedo net 100 may be deployed from the ship 12 using various techniques and/or methods and one of these may comprise a dispensing device 20 which shoots a frangible canister 22 away from the ship for deployment of the anti-torpedo net 100. As illustrated in the drawing, the net 100 is deployed in a manner to intercept the track of the torpedo threat 50 such that it entangles the torpedo within its net structure. The net 100 may entangle the control functions of the torpedo such that its internal guidance system is defeated and/or the mass of the net structure will provide sufficient drag forces to the torpedo which cannot be overcome by its propulsion system. In either case, the torpedo is defeated from carrying out its intended function.

As further illustrated in a second scenario, the surface ship 12 may also carry a helicopter 14 onboard for ASW purposes and such helicopter may be used to deploy the anti-torpedo net 100. Again, various techniques and methods may be used to accomplish the deployment of the net 100 including a frangible canister 22 which may be dropped or otherwise launched from the helicopter such that a net 100 is positioned appropriately within the pathway track of the torpedo 50. Thus, the torpedo threat 50 is intercepted by the net 100 and it is entangled within the mesh of the net structure and defeated in the manner described above.

As further illustrated in a third scenario of FIG. 1, a net 100 may also be deployed from a submarine 16 as a self-protect or countermeasures device to defeat a torpedo threat 52. The net 100 may be deployed via a frangible canister 22 which is launched from the submarine 16 by way of its countermeasures dispenser (not shown) which may be located near the rear of the boat. Countermeasures dispensers of the type alluded to are known in the art and such will not be specifically described here suffice to say that a frangible canister 22 is launchable from such dispenser. In any event, a frangible canister 22 may be broken up by the forces imposed on it as it exits the submarine and/or various other means may be used to extricate the net 100 from within the canister. For example, a tether line 102 may be used to draw the net 100 free from within the canister 22 and to deploy it in its intended full-form configuration. Upon being deployed, the tether 102 will break away from the submarine when the tensile forces on it reach a predetermined break strength. In this manner, the net deployment is totally passive and will not aid an enemy in locating the submarine 16 which may now take other evasive actions.

Figure 2:
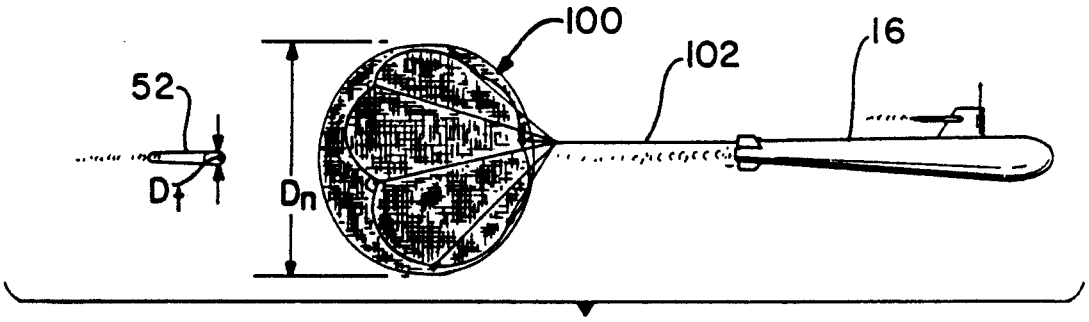
FIG. 2 illustrates a particular deployment mode in which a submarine deploys a tethered net structure as a self-protect torpedo countermeasure.

FIG. 2 of the drawings illustrates a particular mode of deploying an anti-torpedo net 100 from a submarine 16 to defeat a torpedo threat 52. The drawing illustrates the approximate sizes of the submarine 16, the torpedo 52, and the deployed condition of a net 100. For example, a net 100 may be configured to have a diameter $D_n$ within the range of 10–100 feet (3.05–30.5 meters) while the diameter $D_t$ of a conventional torpedo 52 will be about 2 feet (0.6 meters). Thus, the area coverage of a net 100 will be at least five times the frontal area exposure of a torpedo 52 and may be as much as ten times the frontal exposure of such torpedo. Anti-torpedo nets 100 exhibiting greater diameters $D_n$ may, of course, be made but this will be determined by the volume capacity of the deployment canister 22 and the achievable packing density of the net. For example, it has been determined that a net 100 having a diameter $D_n$ of about 80 feet (24.4 meters) may be made in accordance with this invention as will be described hereinafter and such net will exhibit a packing density to meet the constraints imposed by the known and available countermeasures dispenser canister 22. A net 100 having a diameter greater than 80 feet may be made but then the dispenser canister 22 will have to be of greater volume capacity to stow such net. This constraint is not considered to be a limiting facter in the practice of the present invention.

Figure 3:
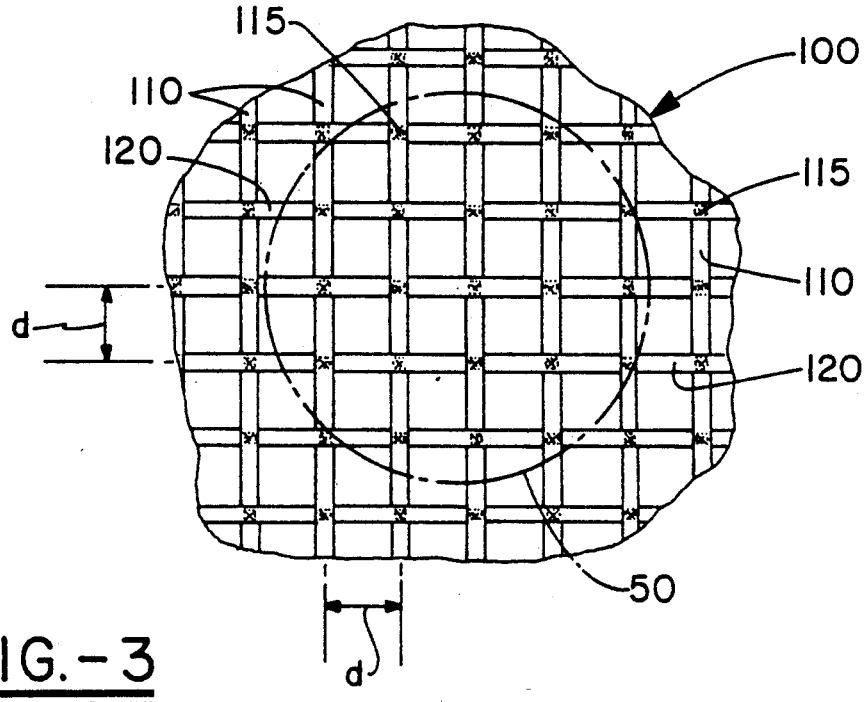
FIG. 3 is a plan view of a small area portion of an anti-torpedo net constructed in accordance with the present invention.

Referring now to FIG. 3 of the drawings, a portion of a net 100 is shown in plan view as the net comprises a plurality of textile ribbons 110 and 120. The ribbons 110 and 120 are flat ribbons comprised of synthetic yarns taken from the group comprising nylon, polyester, aramid, KEVLAR, and SPECTRA (KEVLAR a trademark of the E. I. Du Pont de Nemours Company; SPECTRA a trademark of the Allied Chemical Corporation). More preferably, the ribbons 110,120 will be comprised of SPECTRA yarns in combination with nylon, polyester, aramid, or KEVLAR yarns in an 80-to-20 percent ratio by volume in favor of SPECTRA. This combination of yarns exhibits a high strength-to-weight ratio and substantially neutral buoyancy in salt water. For example, an 80-to-20 percent mix of yarns of SPECTRA and KEVLAR will produce ribbons which exhibit substantially neutral buoyancy in salt water inasmuch as SPECTRA yarns exhibit a specific gravity of about 0.97 while KEVLAR yarns exhibit a specific gravity of about 1.44. Both of these yarns exhibit comparable stiffness and elongation specifications and when the ribbons 110 and 120 are comprised of this combination of yarns they will share any loading forces imposed on a net 100. A SPECTRA-KEVLAR ribbon capable of accepting a 1,000 pound tensile load will exhibit a weight of about 0.20 oz/yd. Ribbons 110,120 of this combination of yarns which are 0.25 inches (6.35 mm) wide will construct a net having a diameter $D_n$ of 80 feet (24.4 meters) which will weigh approximately 140 pounds (63.5 kilograms).

As illustrated in FIG. 3 of the drawings, the ribbons 110,120 may be oriented in a square woven pattern with intersections at 115. The ribbons are woven in warp and weft orientation and the intersections 115 are sewed using a box-X or box-Z stitching pattern using KEVLAR threads. Intersections which are made in accordance with the above will insure failure of any ribbon 110 or 120 only outside of the intersection and this is necessary to insure capture of an active torpedo.

The net mesh spacing indicated at "d" in FIG. 3 is also an important consideration in the construction of a net 100. Inasmuch as the ribbons 110,120 must accept the loading produced during engagement with a torpedo as the net collapses about the nose of the torpedo, the spacings "d" must be such that any hole produced due to breakage of any ribbon 110 or 120 will be still small enough to contain a torpedo. For example and as illustrated in FIG. 3, a net comprised of 1.0 inch (2.54 cm) wide ribbons 110,120 having spacings "d" on 4.0 inch (10.6 cm) centers is shown as it may be engaged by a conventional torpedo 50 indicated by the dot-dash ghost lines. Failure of one of the intersections, if such would occur, will result in an allowable spacing of about 7 inches (17.78 cm), and this, to contain a 21 inch (53.34 cm) diameter torpedo. Accordingly, it has been determined that the spacings "d" may be within the range of 4–12 inches (10.16–30.48 cm) when the ribbons 110,120 have widths within the range of 0.25–1.5 inches (6.35–38.1 mm) respectively.

Figure 4:
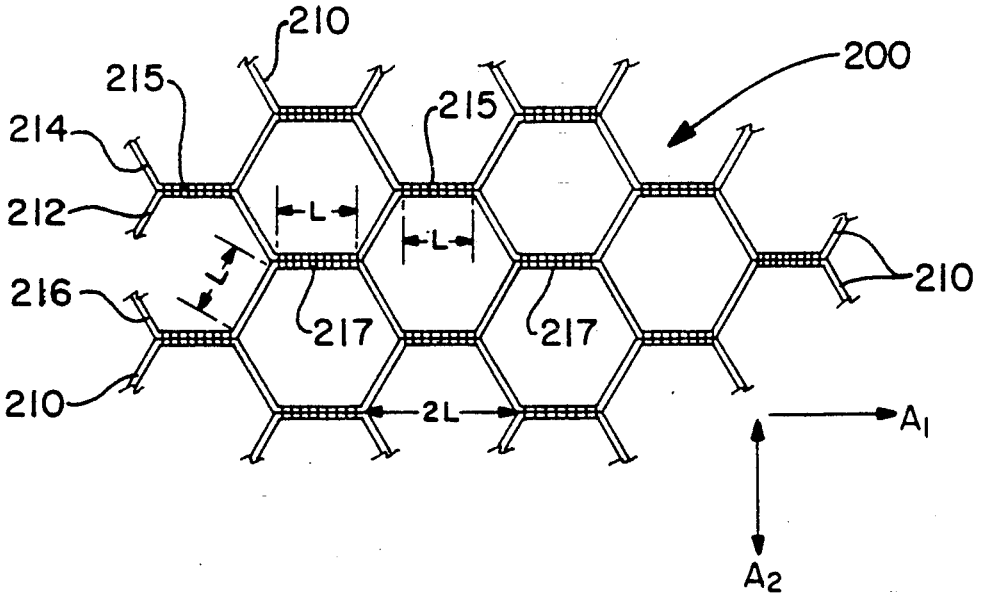
FIG. 4 is a plan view of a small area portion of an alternative geometric configuration of the net structure forming the present invention.

Referring to FIG. 4 of the drawings an alternative ribbon orientation is illustrated and generally indicated by reference numeral 200. The net structure 200 comprises a plurality of flat ribbons 210 which are oriented to form a plurality of interconnected hexogonals which are formed when the ribbons 210 are stitched together in a particular manner.

A hexagon, of course, is a polygon having six equal length sides and the area of a hexagon is determined by the length of its sides. In FIG. 4, a side length is indicated at "L" and all sides of a desired hexagon will have a length equal to "L". As further illustrated in the drawing, a first ribbon 212 is stitched to a second ribbon 214, the stitched length 215 being equal to a hexagon side length "L". The stitching is stopped as between ribbons 212 and 214 for a length "L" and resumed again but, the ribbon 212 is now stitched to a third ribbon 216 for a length 217 which is also equal to "L". Again, stitching is stopped as between ribbons 212 and 216 and, after a length "L", is resumed again as between ribbons 212 and 214. Thus, the stitching alternates as between ribbon 212 and adjacent ribbons 214 and 216 and it also alternates with side lengths "L" which are not stitched. This stitching pattern is continued in the direction of arrow $A_1$ until the desired length of net structure is achieved in that direction. Concurrently, additional ribbons 210 may be added in the same stitching pattern until a complete net is realized in the direction of arrow $A_2$.

It will be recognized and as indicated in FIG. 4, that the maximum length of opening in a net structure having the hexagon pattern will be equal to "2L". Accordingly, and to insure that the net structure captures an active torpedo, the length "2L" will be within the range of 4–8 inches (10.16–20.32 cm). It will also be recognized that the hexagon pattern offers an advantage in that, when the net structure is completely collapsed for stowage, the packing density is enhanced by the very nature of its construction.

Finally, the packing density of a net 100 and/or 200 is an important consideration inasmuch as such net may be carried onboard light aircraft or onboard a submarine where it may be used as a self-protect countermeasure against a homing torpedo. Accordingly, it has been found that flat ribbons 110, 120, and/or 210 may achieve a packing density of about 45 pounds per cubic foot (730 kgms/m$^3$). At this level of packing density, a net structure 100 and/or 200 exhibits a volumetric loading capacity which is approximately equal to forty percent that of high explosive type countermeasures as presently known and used in this art and these exhibit a packing density of about 114 lbs/ft$^3$ (1828.5 kgms/m$^3$). The advantages of the present invention should be clearly obvious!

From the foregoing, it will be recognized that various modifications may be made to the ribbon geometric pattern without departing from the spirit or scope of the invention. For example, the ribbons 110 and 120 may be oriented at a bias angle which may vary within the range of 0–90 degrees. Of course, the pattern of FIG. 3 is at an angle of 90 degrees. The actual geometric orientation of the ribbons will, therefore, be dictated by the volume capacity of a stowage container 22 and/or by the diameter dimension of the torpedo to be captured by the net structure. Obviously, the shorter the dimensions "d" and/or "L" may be, the larger the volume of stowage capacity needed for a particular diameter net structure 100 and/or 200.

What is claimed is:

1. A device for deployment into a water environment to defeat an active torpedo comprises in combination:

a net structure comprised of flat ribbon materials forming a hexogonal geometric pattern and at uniform spacings with stitched interconnections, the interconnections being made alternately between adjacent ribbons for a length "L" equal to a hexagon side length and alternately at spaced lengths "L" between stitched interconnections, the ribbon materials comprising yarns of SPECTRA in combination with yarns taken from the group comprising nylon, polyester, aramid, and KEVLAR.

2. A device as set forth in claim 1 wherein the flat ribbon materials comprise 80 percent SPECTRA.

3. A device as set forth in claim 1 wherein the flat ribbon materials exhibit widths within the range of 0.25–1.5 inches (6.35–38.1 mm) and a net mesh spacing of the ribbons is within the range of 4–12 inches (10.16–30.48 cm).

4. A device as set forth in claim 1 wherein the interconnections are stitched with KEVLAR threads in a box-X stitching pattern.

5. A device as set forth in claim 1 wherein the interconnections are stitched with KEVLAR threads in a box-Z stitching pattern.

6. A device as set forth in claim 1 wherein the greatest length of opening in the hexagon pattern is equal to 2L and is within the range of 4–8 inches (10.16–20.32 cm).

7. A device as set forth in claim 1 wherein the flat ribbons comprise a combination of SPECTRA yarns with KEVLAR yarns in an 80–20 percent by volume ratio in favor of SPECTRA yarns.

8. A device as set forth in claim 1 wherein the net structure exhibits a deployed diameter of at least 10 feet (3.05 m) and a packing density of 45 lbs/ft$^3$ (730 kgms/m$^3$).

9. A device as set forth in claim 1 wherein the interconnections are stitched with KEVLAR threads.

10. An autonomous countermeasures device for deployment into an ocean environment to defeat an active torpedo comprises in combination:

a net structure comprised of flat ribbon materials in a square-woven warp and weft geometric pattern and at uniform spacings between parallel adjacent ribbons with stitched interconnections, the ribbons comprising yarns of SPECTRA in combination with yarns taken from the group comprising nylon, polyester, aramid, and KEVLAR and having widths within the range of 0.25–1.5 inches (6.35–38.1 mm) and the spacings between adjacent ribbons being within the range of 4–12 inches (10.16–30.48 cm), said net structure having a deployed diameter of at least 10 feet (3.105 m) and a packing density of not more than 45 lbs/ft$^3$ (730 kgms/m$^3$).

11. A device as set forth in claim 10 wherein the flat ribbons have interconnections which are stitched with KEVLAR threads.

12. A device as set forth in claim 10 wherein the stitched interconnections are in a box-X stitching pattern.

13. A device as set forth in claim 10 wherein the stitched interconnections are in a box-Z stitching pattern.

14. A device as set forth in claim 10 wherein the ribbons comprise SPECTRA yarns in combination with KEVLAR yarns in an 80–20 percent by volume ratio in favor of SPECTRA yarns.

* * * * *